US005804032A

United States Patent [19]

Reinders

[11] Patent Number: 5,804,032

[45] Date of Patent: Sep. 8, 1998

[54] DEVICE FOR INTRODUCING A FOIL STRIP INTO THE PINCH BETWEEN TWO ROLLERS

[76] Inventor: Johannes Antonius Maria Reinders, De Braak 2, 8101 GJ, Raalte, Netherlands

[21] Appl. No.: 666,456

[22] PCT Filed: Jan. 2, 1995

[86] PCT No.: PCT/NL95/00003

§ 371 Date: Sep. 10, 1996

§ 102(e) Date: Sep. 10, 1996

[87] PCT Pub. No.: WO95/18056

PCT Pub. Date: Jul. 6, 1995

[30] Foreign Application Priority Data

Dec. 31, 1993 [NL] Netherlands ..... 9302291

[51] Int. Cl.[6] ..... B65H 23/10; B65H 37/04

[52] U.S. Cl. ..... 156/555; 156/494; 156/499; 242/419; 242/419.9

[58] Field of Search ..... 156/494, 495, 156/555, 160, 499; 242/154, 156.1, 419.9, 419

[56] References Cited

U.S. PATENT DOCUMENTS

| | | | |
|---|---|---|---|
| 2,710,153 | 6/1955 | Baumrucker . | |
| 2,956,300 | 10/1960 | Bruno . | |
| 2,957,639 | 10/1960 | Muller . | |
| 3,309,983 | 3/1967 | Dresser | 156/555 |
| 3,978,637 | 9/1976 | Mauriello | 156/555 |
| 4,226,664 | 10/1980 | Shaffer | 156/499 |
| 4,605,457 | 8/1986 | Guy | 156/494 |
| 5,011,561 | 4/1991 | Carolus | 156/495 |

FOREIGN PATENT DOCUMENTS

| | | |
|---|---|---|
| 298687 | 1/1989 | European Pat. Off. . |
| 464616 | 1/1992 | European Pat. Off. . |
| 1214068 | 4/1966 | Germany . |
| 1499108 | 10/1969 | Germany . |
| 60-161853 | 8/1985 | Japan . |
| 668589 | 1/1989 | Switzerland . |
| 826251 | 12/1959 | United Kingdom . |
| 2067524 | 7/1981 | United Kingdom . |
| 8910847 | 11/1989 | WIPO . |

*Primary Examiner*—Daniel Stemmer
*Attorney, Agent, or Firm*—Webb Ziesenheim Bruening Logsdon Orkin & Hanson, P.C.

[57] ABSTRACT

A apparatus having a stock roll of foil and a device for introducing a foil strip coming from the stock roll into a pinch between two rollers. The foil has a glue layer on an outer surface of the foil. A braking member is positioned between the stock roll and a roller to exert a braking force on the foil strip. The foil is in contact with the braking means via the glue layer.

6 Claims, 3 Drawing Sheets

DEVICE FOR INTRODUCING A FOIL STRIP INTO THE PINCH BETWEEN TWO ROLLERS

BACKGROUND OF THE INVENTION

The invention relates to a device for introducing a foil strip coming from a stock roll into the pinch between two rollers, for instance simultaneously with a plate or other flat object onto which the foil must be arranged by means of an adhesive layer.

The object of the invention is to introduce the foil such that a well defined travel of the foil strip through the device is ensured. Such a well defined travel may for instance not, or only to a negligible extent, depend on the friction which the stock roll undergoes during rotation.

SUMMARY OF THE INVENTION

The device according to the invention includes braking means placed between the stock roll and a roller to exert a braking force on the foil strip.

The device can for instance be embodied such that the braking means comprise a braked roller.

The roller can for instance be braked by an adjustable brake.

A particular embodiment has the feature that a free-rotating guide roller is arranged between the stock roll and the braked roller, which guide roller determines the tangent plane along which the foil strip reaches the braked roller. Since the tangent plane along which the foil strip leaves the braked roller is stationary, the free-rotating guide roller determines the angle at which the foil strip lies against the braked roller.

In a variant the device has the feature that the position of the guide roller is adjustable.

In another embodiment the device has the feature that the braking means comprise a fixedly disposed braking surface. This braking surface can have a desired shape, for instance a desired curved or flat shape. In the case of a flat shape it is recommended that the input edge and the output edge have a curved, fluent form. It will be apparent that bending of the foil preferably remains limited.

A preferred embodiment has the special feature that the braking surface has a length which is not dependent on the quantity of foil present on the stock roll.

In a specific embodiment this device has the feature that a guide roller is arranged between the stock roll and the braking surface which determines the tangent plane along which the foil strip reaches the braking surface. The fixedly disposed braking surface can for instance be the outer surface of a fixedly disposed cylinder. Due to the presence of the free-rotating roller, which determines the input tangent plane, and the fixed position of the output tangent plane, the angle at which the foil strip lies against the fixed cylinder is known with this embodiment. This angle determines the braking force exerted on the foil strip. The braking force has hereby become very well controllable.

It may be desirable in some conditions to be able to adjust the braking force. To this end the above described embodiment can have the feature that the position of the guide roller is adjustable.

In a specific embodiment the device has the special feature that the braking means are adapted to heat the foil strip and that at least the associated roller is heated.

This embodiment can advantageously have the special feature that the braking means are heated by the associated roller.

A specific embodiment has the characteristic that the foil is of the type with a glue layer present on an outer surface, in particular a glue layer which can be heat-activated, and that the arrangement is such that the foil can be in contact with the braking means via the glue layer.

A variant has already described above wherein the braking means comprise a fixedly disposed braking surface. A particular embodiment hereof has the feature that the braking surface comprises a curved input edge, a curved output edge and a middle part connecting fluently thereto. When there is variation in the position of the input tangent plane of the foil strip as a result of variations in the amount of foil present on the stock roll, the angle at which the foil strip lies against the curved input edge will vary. The change caused hereby in the effective braking force exerted on the foil strip will be very small relative to the braking action of the middle part and the output edge, and will even be negligible in practice.

A particular embodiment has the special feature that the middle part is flat.

BRIEF DESCRIPTION OF THE DRAWINGS

The invention will now be elucidated with reference to the annexed drawings, wherein.

DESCRIPTION OF THE PREFERRED EMBODIMENT

Figure 1:
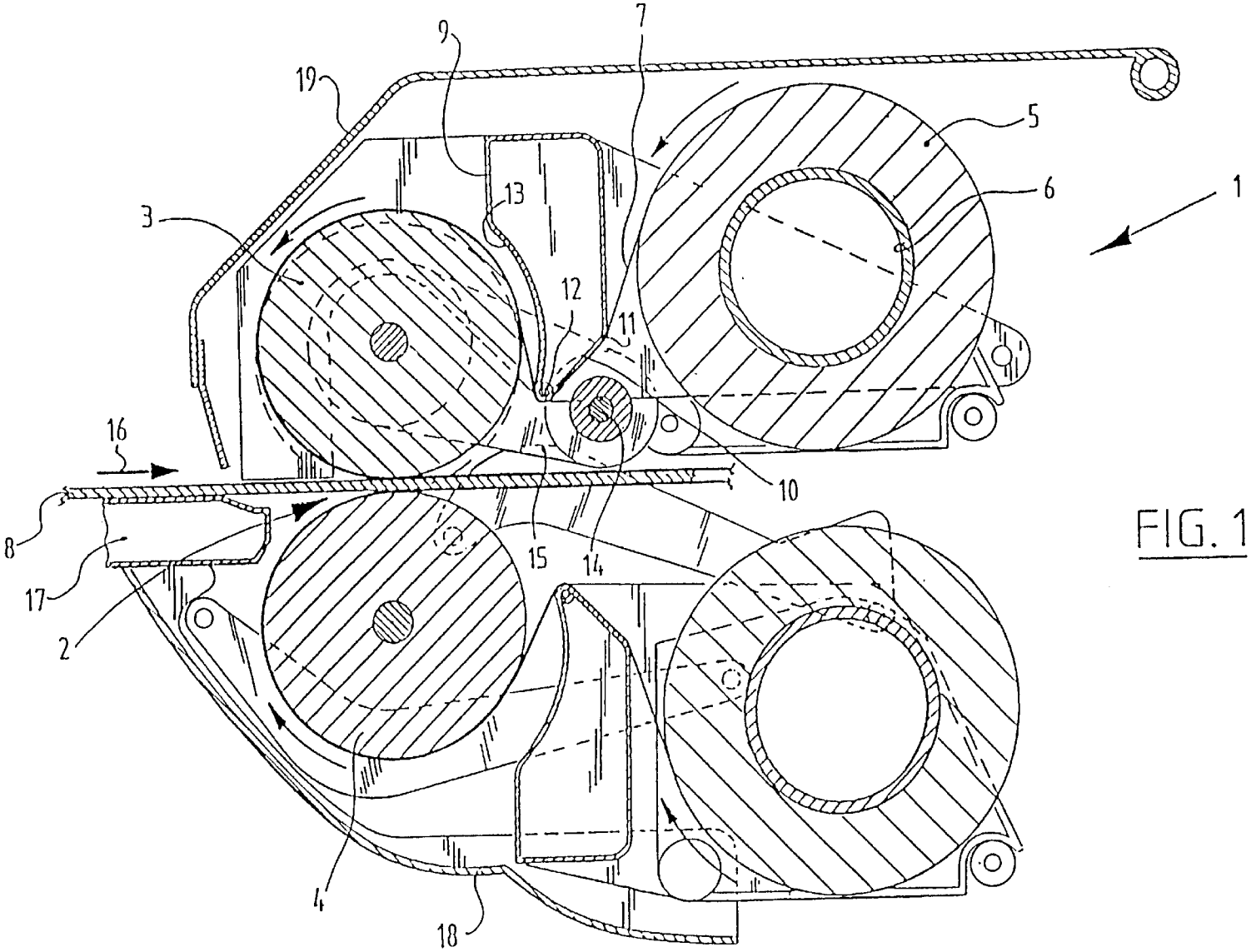
FIG. 1 shows a cross section through a device according to the invention.
Figure 2:
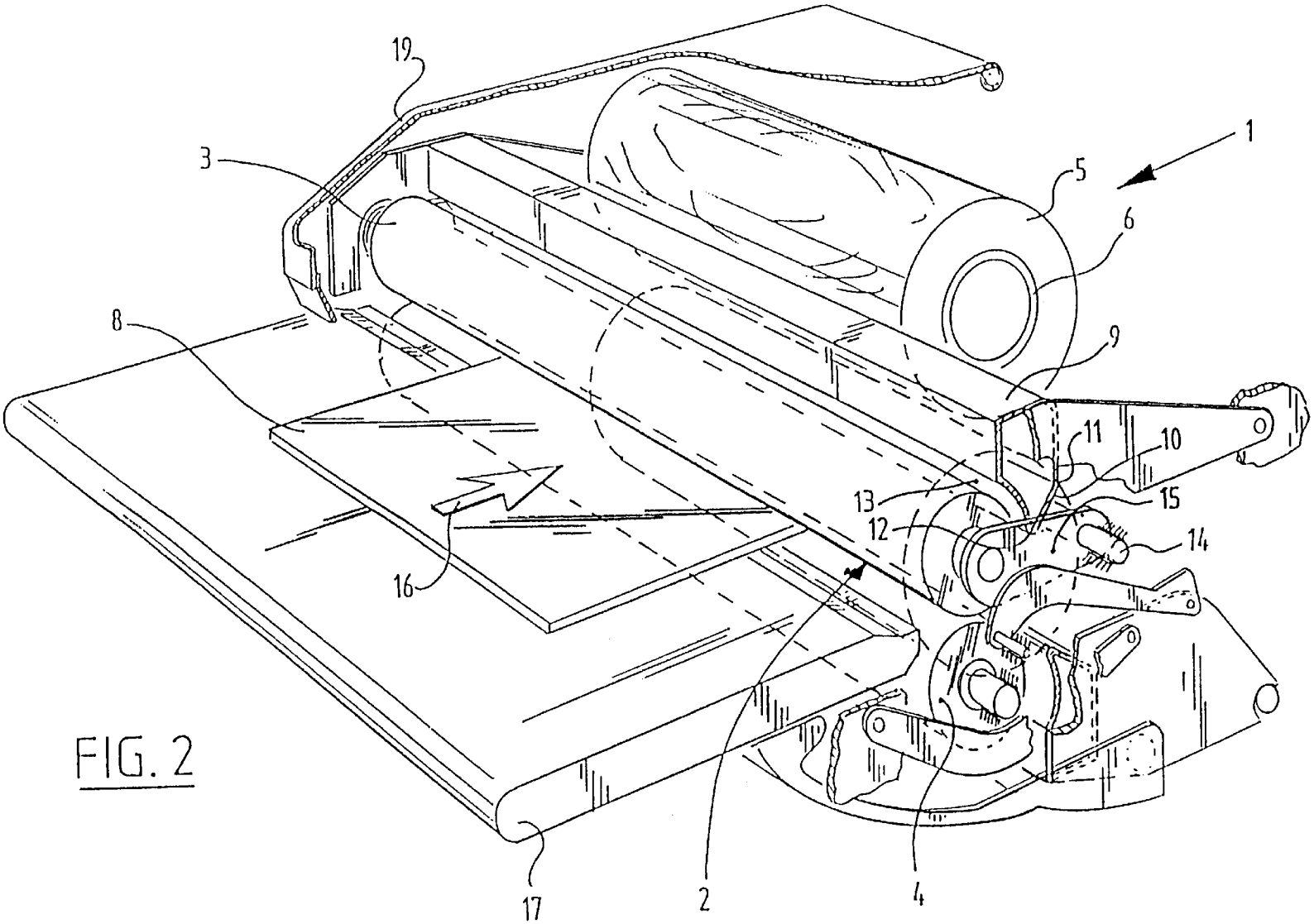
FIG. 2 shows a perspective view of the device according to FIG. 1.

FIGS. 1 and 2 show a device 1 for introducing into the pinch 2 between two heated rollers 3, 4 pressed toward each other of a foil strip 7 coming from a stock roll 5 with a hollow core 6. This occurs simultaneously with the introduction of a plate 8 onto which the foil 7 must be applied.

The foil 7 is provided with a glue layer on its outer side in the situation wound onto the stock roll 5. In this embodiment this glue layer is of the type which can be activated by heat. In order to activate the glue the foil strip 7 is trained round a largest possible part of the periphery of roller 3. In this embodiment the foil 7 lies at an angle of about 270° against the roller 3. Not drawn are drive means for driving the rollers 3, 4.

A hollow metal box guide 9 is arranged between roller 3 and stock roll 5. The foil strip 7 is guided in the manner shown round the box guide 9. This latter has on its underside a flat surface 10 with a rounded input surface 11 connecting fluently thereto and an output surface 12 connecting fluently thereto. The radii of curvature of the surfaces 11, 12 are large such that the foil can withstand these deflecting operations. Of importance is that the foil lies against the flat braking surface 10. Because the extension of this surface 10 intersects the cylindrical peripheral surface of the hollow core 6, the length over which the foil strip 7 extends is substantially independent of the quantity of foil 7 present on stock roll 5.

The box guide 9 further has a curved surface 13 corresponding with the form of the roller 3. This surface 13 absorbs an amount of heat from the heated roller 3 such that through heat conduction a certain temperature rise also occurs at the location of flat surface 10 and the surfaces 11 and 12, whereby foil 7 already undergoes a certain preheating at these positions.

In per se known manner the roller 3 is vertically movable round a swivel centre line 14 by means of a supporting frame 15. Plates 8 of different thicknesses can thus be fed through the device 1 in the direction of arrow 16. Not drawn are means which fix the pressure force at a desired value.

Of importance is that at the position of the pinch 2 the foil is placed smoothly and tautly round the roller. This enhances quality, in particular the smoothness and the absence of air inclusions after adhesion of the foil with its adhesive layer to the plate 8. The device according to the invention ensures this well defined and controlled travel of the foil.

The rollers 3, 4 can for instance be heated to a temperature in the order of 120° C. It will be apparent that this temperature is subject to the nature of the applied materials, particularly the temperature resistance of foil 7 and the temperature to which the adhesive layer must be heated.

The braking force obtained does not depend on the width of the foil.

Attention is drawn to the fact that only the upper part of the device 1 is described. The lower part has the same basic structure and will therefore not be described.

The insertion of the plate material 8 takes place by pushing in the input direction 16 over an input table 17. The device further has a housing 18 with a fold-up cover 19.

Figure 3:
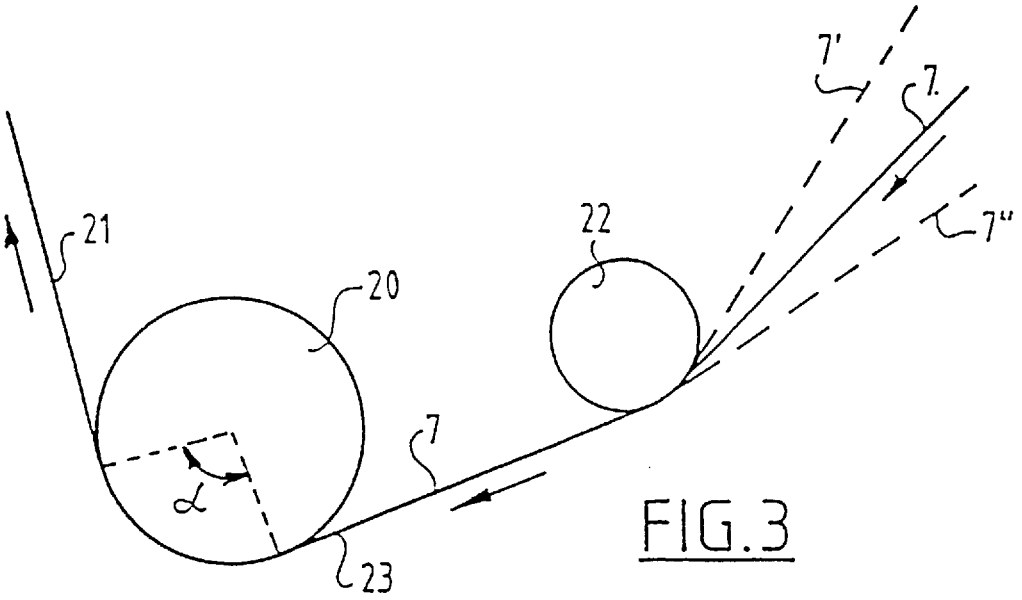
FIG. 3 shows a schematic side view of a second embodiment.

FIG. 3 shows a flatly disposed braking cylinder 20 over which the foil strip 7 is carried. As will be apparent with reference to FIG. 1, the output tangent plane 21 of foil strip 7 is constant. The foil strip 7 is fed from stock roll 5 to braking cylinder 20 via a fixedly disposed, free-rotating guide roller 22. As a result of this arrangement the input tangent plane 23 of foil strip 7 relative to braking cylinder 20 is constant. The tangent planes 21 and 23 define the angle $\alpha$ at which foil strip 7 lies against the outer surface of braking cylinder 20. It will be further apparent from FIG. 3 that the input angle of the foil strip relative to the guide roller 22 can vary between the position designated with 7', which corresponds with a substantially full stock roll 5, and the position designated with 7", wherein the stock roll 5 is almost empty. As will be apparent with reference to the foregoing, this does not influence the friction force exerted on foil strip 7 determined by the angle $\alpha$ and the properties of braking cylinder 20.

Figure 4:
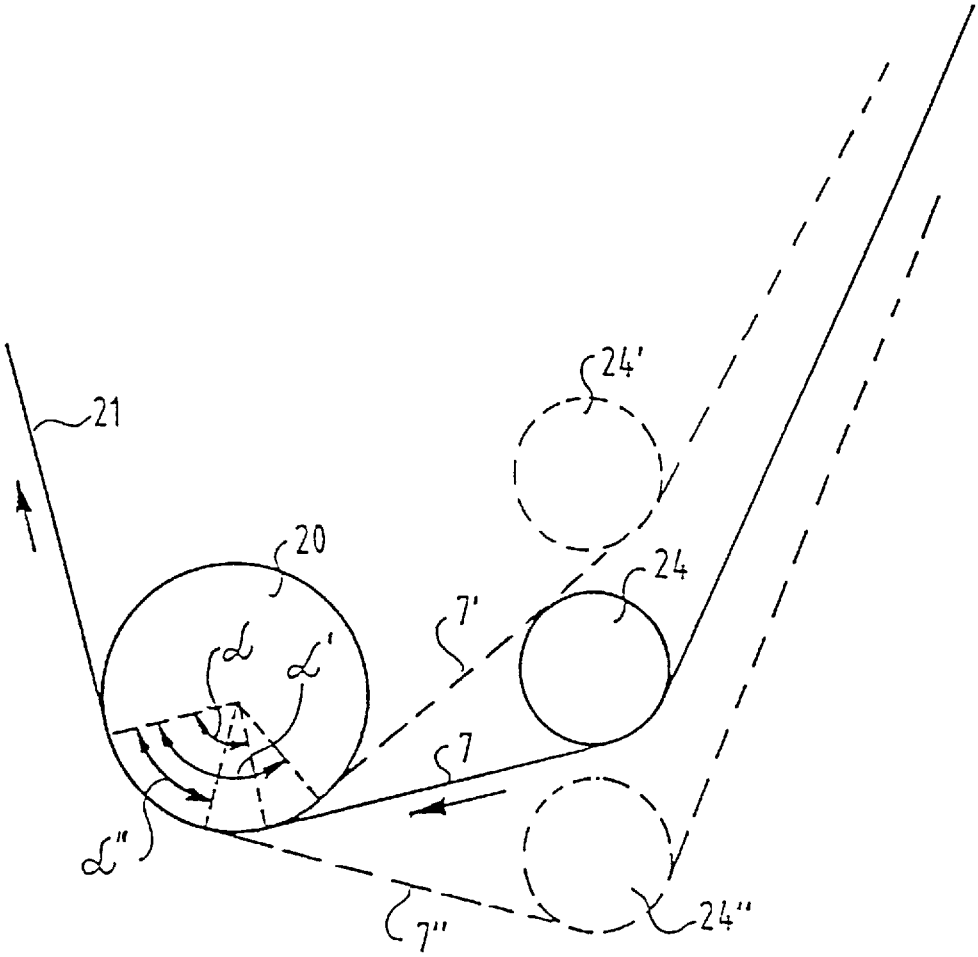
FIG. 4 shows a view corresponding with FIG. 3 of a third embodiment.

FIG. 4 shows that a free-rotating guide roller 24 has a variable position. In the intermediate position drawn in full lines and corresponding with the situation of FIG. 3, the foil strip 7 lies at the angle $\alpha$ against the braking cylinder 20. In a second position, wherein the guide roller is designated 24', foil strip 7' lies at an angle $\alpha'$, while in the position of the guide roller designated 24", the relevant angle has the value $\alpha''$. Not shown in FIG. 4 is that in each of the said positions of guide roller 24 the input angle of foil strip 7 relative to guide roller 24 may vary as according to FIG. 2 without this influencing the braking force exerted by the braking cylinder 20 on foil strip 7. This is in any case wholly determined by the angle at which the foil strip lies against the braking cylinder 20.

I claim:

1. An apparatus comprising:

a pair of rollers with a pinch formed therebetween, wherein at least one of the rollers is heated;

at least one stock roll of foil, the foil having a glue layer on an outer surface of the foil;

braking means positioned between the at least one stock roll and at least one roller of the pair of rollers to exert a braking force on the foil, wherein the foil is in contact with the braking means via the glue layer, wherein the braking means includes a stationary braking surface having a curved input edge, a flat middle part and a curved output edge, and wherein the braking means further includes a curved surface complementary to and adjacent the at least one heated roller such that the curved surface absorbs heat from the at least one heated roller to heat the stationary braking surface thereby preheating the foil.

2. The apparatus as claimed in claim 1, wherein the stock roll of foil is rotatably carried on a core having an outer peripheral surface and wherein a plane containing the flat middle part intersects the peripheral surface of the core.

3. A combination, comprising:

a device configured to introduce a foil strip from a stock roll into a pinch between two rollers;

a stock roll of foil, said foil having a glue layer on an outer surface of the foil; and braking means positioned between the stock roll and a roller to exert a braking force on the foil strip, wherein the foil is in contact with the braking means via the glue layer, wherein the braking means comprise a fixedly disposed braking surface, wherein a roller adjacent the braking means is heated such that the braking means are heated by the adjacent roller, and wherein the braking surface includes a curved input edge, a curved output edge and a flat middle part such that the length of the braking surface is not dependent upon the quantity of foil present on the stock roll.

4. The combination according to claim 3, wherein the glue layer is heat-activated.

5. A combination, comprising:

a device for introducing a foil strip coming from a stock roll into a pinch between two rollers;

a stock roll of foil, said foil having a clue layer on an outer surface of the foil;

braking means positioned between the stock roll and a roller to exert a braking force on the foil strip; and a free-rotating guide roller arranged between the stock roll and the braked roller, which guide roller determines a tangent plane along which the foil strip reaches the braked roller, wherein the foil is in contact with the braking means via the glue layer, wherein the braking means comprise a braked roller and wherein a position of the guide roller is adjustable.

6. The combination as claimed in claim 5, wherein a guide roller is arranged between the stock roll and the braking means and the guide roller determines a tangent plane along which the foil strip reaches the braking surface, such that the braking surface has a length which is not dependent on a quantity of foil present on the stock roll.

* * * * *

UNITED STATES PATENT AND TRADEMARK OFFICE

CERTIFICATE OF CORRECTION

PATENT NO. : 5,804,032

DATED : September 8, 1998

INVENTOR(S) : Johannes A. M. Reinders

It is certified that error appears in the above-identified patent and that said Letters Patent is hereby corrected as shown below:

Column 2 Line 36 "EMBODIMENT" should read --EMBODIMENTS--.

Claim 5 Column 4 Line 44 "clue layer" should read --glue layer--.

Signed and Sealed this

Sixteenth Day of February, 1999

*Attest:*

*Attesting Officer*

*Acting Commissioner of Patents and Trademarks*